US009714103B2

(12) United States Patent
Antoniazzi et al.

(10) Patent No.: US 9,714,103 B2
(45) Date of Patent: Jul. 25, 2017

(54) PACKAGING MACHINE FOR PACKING ROLLS OF PAPER AND THE LIKE

(71) Applicant: Fabio Perini Packaging S.p.A., Bologna (IT)

(72) Inventors: Luca Antoniazzi, Bologna (IT); Gabriele Canini, San Giorgio di Piano (IT); Valter Di Nardo, Capannori (IT)

(73) Assignee: Fabio Perini Packaging S.p.A., Calderara di Reno (Bologna) (IT)

( * ) Notice: Subject to any disclaimer, the term of this patent is extended or adjusted under 35 U.S.C. 154(b) by 582 days.

(21) Appl. No.: 14/350,607

(22) PCT Filed: Oct. 3, 2012

(86) PCT No.: PCT/IB2012/055282
§ 371 (c)(1),
(2) Date: Apr. 9, 2014

(87) PCT Pub. No.: WO2013/054229
PCT Pub. Date: Apr. 18, 2013

(65) Prior Publication Data

US 2014/0260087 A1 Sep. 18, 2014

(30) Foreign Application Priority Data

Oct. 10, 2011 (IT) ..... FI2011A000220

(51) Int. Cl.

| | |
|---|---|
| ***B65B 11/22*** | (2006.01) |
| ***B65B 25/14*** | (2006.01) |
| ***B65B 59/00*** | (2006.01) |
| ***B65B 11/26*** | (2006.01) |

(52) U.S. Cl.
CPC ..... *B65B 11/22* (2013.01); *B65B 11/26* (2013.01); *B65B 25/146* (2013.01); *B65B 59/00* (2013.01)

(58) Field of Classification Search
CPC ..... B65B 11/12; B65B 11/16; B65B 11/22; B65B 11/26; B65B 25/146; B65B 25/24; B65B 49/02; B65B 49/04; B65B 49/08; B65B 49/12; B65B 49/14
USPC ..... 53/204, 209, 210, 220, 221, 228, 230, 53/231, 232, 233
See application file for complete search history.

(56) References Cited

U.S. PATENT DOCUMENTS

| | | | | |
|---|---|---|---|---|
| 2,301,016 A | | 11/1942 | Cannard | |
| 2,383,664 A | * | 8/1945 | Malhiot | B65B 25/148 118/231 |
| 3,855,758 A | * | 12/1974 | Walter et al. | B65B 11/22 53/226 |
| 4,624,096 A | * | 11/1986 | Nordstrom | B65B 11/12 53/209 |
| 4,651,500 A | | 3/1987 | Chaffey | |

(Continued)

FOREIGN PATENT DOCUMENTS

| | | |
|---|---|---|
| CN | 1836977 A | 9/2006 |
| EP | 0995682 A2 | 4/2000 |

(Continued)

*Primary Examiner* — Stephen F Gerrity
(74) *Attorney, Agent, or Firm* — Breiner & Breiner, L.L.C.

(57) ABSTRACT

A packaging machine including an insertion station for inserting the rolls in wrapping sheets; a feed path of the rolls; a conveyor for feeding the rolls along the feed path; and a folding station adapted to be equipped alternatively with different types of folding members, as a function of the type of pack to produce.

29 Claims, 9 Drawing Sheets

(56) References Cited

U.S. PATENT DOCUMENTS

| | | | | |
|---|---|---|---|---|
| 6,067,780 | A | 5/2000 | Gentili et al. | |
| 6,308,497 | B1 * | 10/2001 | Cassoli et al. | B65B 49/08 493/23 |
| 6,691,492 | B2 * | 2/2004 | Gamberini | B65B 25/146 53/230 |
| 6,799,410 | B2 * | 10/2004 | Gamberini | B65B 25/146 53/224 |
| 7,789,219 | B2 | 9/2010 | Baldanza et al. | |
| 2002/0059779 | A1 * | 5/2002 | Gamberini | B65B 11/22 53/228 |
| 2004/0016213 | A1 * | 1/2004 | Loperfido et al. | B65B 25/146 53/461 |
| 2004/0151481 | A1 | 8/2004 | Cassoli et al. | |
| 2005/0229546 | A1 | 10/2005 | Poli et al. | |
| 2009/0139185 | A1 * | 6/2009 | Gorrieri et al. | B65B 25/146 53/251 |

FOREIGN PATENT DOCUMENTS

| | | | | |
|---|---|---|---|---|
| EP | 1067048 | A1 | 1/2001 | |
| EP | 1228966 | A1 | 8/2002 | |
| EP | 1518787 | A1 | 3/2005 | |
| WO | 2004024565 | A1 | 3/2004 | |
| WO | 2007057938 | A1 | 5/2007 | |
| WO | WO 2008096386 | A1 * | 8/2008 | B65B 11/22 |

* cited by examiner

R
(A)
I
R
(B)
I
I
(C)
I
(D)
I
(E)
R
(F)
R
I
(G)

11
81
81F
81T
82
84
86
88
95
56
54
93
105
105A
105B
107
115
23
25
103
101
33
52
R
5
3
I
48
47
37
35
19≡21
15≡17
127
125
129
123
F123
133

PACKAGING MACHINE FOR PACKING ROLLS OF PAPER AND THE LIKE

TECHNICAL FIELD

The present invention relates to packaging machines for packaging rolls of paper, for example tissue paper, such as toilet paper, kitchen towels or the like.

BACKGROUND ART

In the paper converting and roll producing industry packaging machines are known for producing single or multiple packs of rolls of tissue paper, such as toilet paper, kitchen towels or the like. Some of these machines use, to wrap and package the rolls, sheets of plastic material, in particular polyethylene or the like. In these machines, a group of rolls, appropriately arranged in one or more rows and in one or more layers, are inserted into a sheet of plastic and subsequently moved forward by means of a conveyor through a folding station. In the folding station, the flaps projecting from both sides of the group of rolls are folded against the front surfaces of the rolls. At the exit of the folding station the pack thus obtained is made to pass through a sealing station which, by means of suitable heating systems, heats and seals together the folded flaps of the plastic sheet. Examples of machines of this type are disclosed in U.S. Pat. No. 6,067,780; EP-A-0995682; U.S. Pat. No. 7,789,219; EP-A-1067048; EP-A-1228966; US-A-20050229546. Examples of devices for sealing folded lateral flaps of the pack are described in WO-A-2004/024565 and in US-A-20040151481.

Machines of this type are commonly used to produce packs of multiple rolls, normally arranged in adjacent rows and if necessary in several superimposed layers.

In other prior art machines each roll is packaged individually, wrapping it in a sheet of plastic, or more commonly of paper, whose flaps projecting from the flat faces of the roll are folded and inserted into the axial hole of the tubular winding core around which the roll is formed. This packaging system typically goes by the name of "twist-and-tuck", as the flap of the wrapping sheet projecting from each side of the roll is twisted, and then thrust inside the axial hole of the tubular winding core of the roll. Machines of this type are described, for example, in U.S. Pat. No. 4,651,500 and in EP-A-1518787. In particular, in the machine described in EP-A-1518787 the rolls are moved forward individually by means of a conveyor through a folding station. The flaps of the wrapping sheet, projecting from the two sides of the roll, beyond the front faces of said roll, are twisted around themselves, for example by means of a roto-translational movement between two folding profiles. Subsequently, punches moving parallel to the axial direction of the rolls and provided with a reciprocating movement orthogonally to the direction of feed of the rolls, penetrate the tubular core of each roll and insert the previously twisted lateral flaps of the wrapping sheet into the tubular core. The structure of the machine is complex and very bulky, in particular in the dimension parallel to the direction of feed of the rolls.

SUMMARY OF THE INVENTION

Prior art machines of the aforesaid type are designed to perform packaging according to one or other of the two methods described. Therefore, users wishing to produce packs of both types must purchase at least two machines.

Vice versa, the invention proposes a machine that allows these limits to be overcome.

According to the invention there is provided a machine having a conveyor for transferring the rolls from an insertion station towards and through a folding station. The folding station can be equipped alternatively: with first folding members to form packages in sealable plastic film, where the flaps of the wrapping sheet (for example, typically a sheet of polythene) are folded against the front surfaces of the packaged and sealed rolls; and with second folding members to form packs without sealing with wrapping sheets (for example, typically sheets of paper) in which the flaps are folded against the front surfaces of the rolls and inserted into the axial hole of the tubular winding core, for example by means of punches that penetrate the winding core of the roll.

Therefore, according to one embodiment the invention provides a packaging machine for packaging paper rolls comprising:

- an insertion station for inserting the rolls in wrapping sheets;
- a feed path of the rolls;
- a conveyor for feeding the rolls along said feed path;
- a folding station adapted to be equipped alternatively:
  - with first stationary folding members to fold lateral flaps of said wrapping sheets against end surfaces of said rolls;
  - or with second dynamic folding members, to insert lateral flaps of said wrapping sheets inside holes of respective winding cores of said rolls.

In some embodiments, the rolls are fed towards the machine at a lower height with respect to the packaging height. In this case the machine can advantageously comprise an elevator that transfers the rolls from a lower position to a higher position. In advantageous embodiments there are also provided members for applying wrapping sheets around the rolls during transfer. In this case the wrapping sheets can, for example, be positioned horizontally or in any case generally transverse to the trajectory of lifting of the rolls and of insertion of the rolls into the insertion station, so that each roll or group of rolls carried by the elevator draws the wrapping sheet with it and is partly wrapped therein. Wrapping sheet must be intended in general both as a sheet of plastic film intended to form a pack closed by sealing, and as a sheet of paper fastened to the packaged roll by means of insertion of the lateral flaps into the axial hole of the tubular winding core.

It would also be possible to use a system for insertion of the rolls with a different movement with respect to lifting in vertical direction. For example, an insertion with a horizontal movement could be provided. In this case, the wrapping sheet can advantageously be arranged in a substantially vertical plane, or in any case oriented in such a manner as to be intercepted by the trajectory of insertion of the roll or group of rolls.

In some advantageous embodiments the folding station comprises: a first slide and a second slide, arranged at the sides of the feed path and movable according to a direction of movement, transverse with respect to the feed path. The slides can be positioned at the same height as the path of the rolls, or slightly below or above the path. In some embodiments the movement of the slides is substantially orthogonal to the feed path of the rolls to be packed. In some embodiments, there is also provided at least one actuator to move the slides along the direction of movement. The slides are arranged and designed to receive and alternatively move at least some of the first folding members and of the second folding members, as a function of the type of pack to be produced. In particular, according to some embodiments when the folding station is equipped with the first stationary folding members, the slides are maintained in a stationary position during packaging and the actuator is controlled to adjust the distance between the first stationary folding members. Vice versa, when said folding station is equipped with the second folding members, the slides are controlled by the actuator to move towards and away from each other, synchronized with a stepwise forward movement of said conveyor. In advantageous embodiments a single actuator is provided and has members for mechanical connection to the two slides, for controlling the movement towards and away from each other, whether this is provided to adjust the folding members or is provided to fold the wrapping sheet dynamically. It would also be possible to use two separate actuators, one for each slide, even if the first solution is preferable as it is less expensive and simpler to control and maintain.

In some embodiments, the first stationary folding members comprise, on each side of the feed path, two folding profiles extending from the bottom upward and from the top downward, to fold and press portions of said wrapping sheet against respective front surfaces of the rolls. In advantageous embodiments, the two folding profiles on each side of the feed path are constrained to a respective one of said first slide and second slide.

In some embodiments of the machine, the second folding members comprise, on each side of the feed path, a plurality of mutually spaced apart punches, to insert the flaps of the wrapping sheet into the winding core of the rolls. For example, there can be provided two or three and preferably also four punches on each side of the feed path of the rolls. The punches are arranged in series along the direction of feed of the rolls and the rolls are moved forward stepwise, so that each roll is handled subsequently and sequentially by each punch, i.e. by each pair of punches positioned on the two sides of the feed path. The punches are provided with an insertion and extraction movement, according to a transverse direction with respect to the direction of feed of the rolls along the feed path. The movement is preferably simultaneous for all the punches and all the punches on a same side of the feed path can advantageously be carried by a common element, such as a beam, carried in turn by the respective slide movable transverse to the direction of feed of the rolls. Beams are intended in general as any structure of suitable length to support the various punches at the correct distance between one another.

In some embodiments, on each side of feed path, in addition to the series of punches there can be provided a disk-shaped member surrounding a riveting tip or protuberance, for example conical in shape, which can be coaxial or eccentric with respect to the disk-shaped member. The disk-shaped member can be provided only with a movement parallel to its axis, or it can be rotating about its axis to obtain an increased riveting effect of the wrapping sheet against the packaged roll.

In addition to the aforesaid punches, the second folding members can advantageously comprise, on each side of the feed path of the rolls, at least a first stationary folding profile extending towards the insertion station, i.e. between the insertion station and the position in which said punches are located. Said first stationary folding profile can advantageously be positioned in the upper area of the feed path of the rolls to fold downwards the upper portion of the wrapping sheet projecting from the respective front surface of the roll.

There can preferably also be provided a second stationary folding profile on each side of the feed path of the rolls, positioned downstream of the first stationary folding profile, with respect to the direction of feed of the rolls.

In some embodiments the second folding members comprise, on each side of the feed path, a moving folding profile, provided with a movement of insertion and extraction, for example a lifting and lowering movement, synchronized with the forward movement of the conveyor.

In advantageous embodiments of the invention the conveyor extends from the insertion station towards the folding station and preferably for the entire length of the folding station. In this way each roll or group of rolls is moved using the conveyor for the entire folding cycle, regardless of the type of folding performed and therefore regardless of the type of folding members used. In advantageous embodiments the conveyor extends beyond the folding station so as to take the rolls out of the folding station toward a sealing station, for example, and therefore downstream of all the folding members.

In some advantageous embodiments the conveyor comprises a plurality of seats. Each seat receives a roll in the insertion station and transfers it towards the folding station maintaining it engaged during the action of the folding members.

In some embodiments, the conveyor comprises a first pair of flexible members and a second pair of flexible members, mutually parallel to one another, said first pair of flexible members and said second pair of flexible members being driven around idle and motorized wheels, the angular phase of said first pair of flexible members and of said second pair of flexible members being adjustable.

The seats are configured differently according to the type of folding and packaging cycle to perform. For example, in the case in which the rolls must be wrapped in a wrapping sheet formed by a film of sealable plastic material, each seat can advantageously be formed by fingers placed opposite one another, positioned on one side of the seat and on the opposite side. For each seat the fingers on one side thereof are fastened to a cross-member carried by a first pair of flexible members and the fingers on the opposite side of the seat are fastened to a cross-member carried by the other pair of flexible members. Vice versa, when single rolls are wrapped in wrapping sheets inserted in the central hole of the tubular winding core, with a procedure similar to the "twist-and-tuck" system, for example seats can be used, each of which is fastened to a single cross-member carried by a pair of flexible members. In this case, two consecutive seats are fastened to two consecutive beams, one integral with a first pair of flexible members and the other with the second pair of flexible members.

Further advantageous characteristics and embodiments of the invention are set forth in the appended claims, which form an integral part of the description and will be described in greater detail hereunder, with reference to some examples of embodiment.

The invention also relates to a packaging machine with an insertion station for inserting the rolls in a wrapping sheet, a conveyor with a plurality of seats that each receive a roll, and an assembly of dynamic folding members, comprising a plurality of pairs of punches, the punches of each pair being arranged on opposite sides of a feed path of the rolls. Each roll is moved forward stepwise engaged in a seat of the conveyor to stop between the punches of each pair. In the forward movement step, on each side of the feed path a respective, stationary or movable, folding profile overturns a portion of flap of the wrapping sheet projecting from the roll to press it against the corresponding front surface of the roll. In the subsequent pause step the punches insert a part of the folded flap inside the axial hole of the tubular winding core. In this way, a packaging similar to the "twist-and-tuck" system is performed stepwise, but more gradually, as consecutive portions of the flap of wrapping sheet projecting from the roll are gradually inserted into the tubular winding core.

BRIEF DESCRIPTION OF THE DRAWINGS

The invention will be better understood by following the description and accompanying drawing, which shows a non-limiting practical embodiment of the invention. More in particular, in the drawing.

DETAILED DESCRIPTION OF EMBODIMENTS OF THE INVENTION

Referring first to FIGS. 1 to 5 the machine is described in its arrangement for producing packs of rolls wrapped in plastic material with folding and sealing of the flaps on the front surfaces of the rolls.

Figure 1:
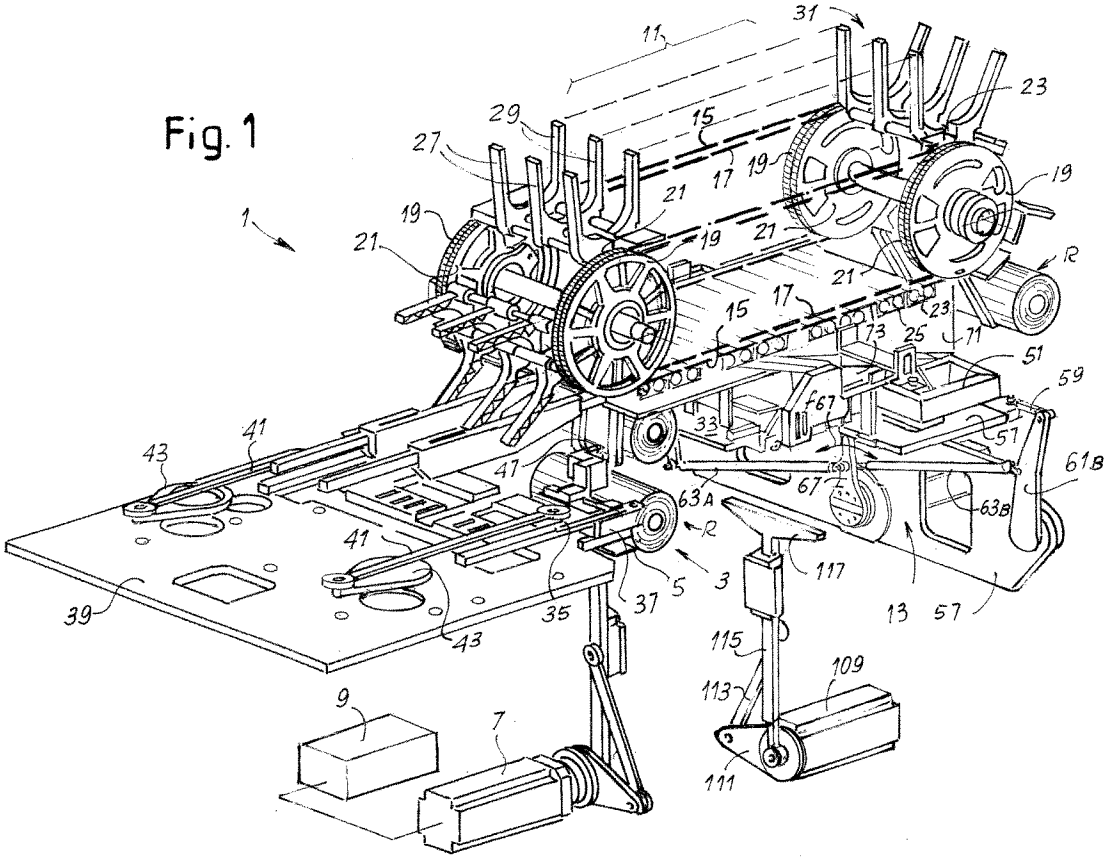
FIG. 1 shows an axonometric view with parts removed of the machine in one embodiment, in the configuration for packaging rolls with sheets of plastic material.
Figure 2:
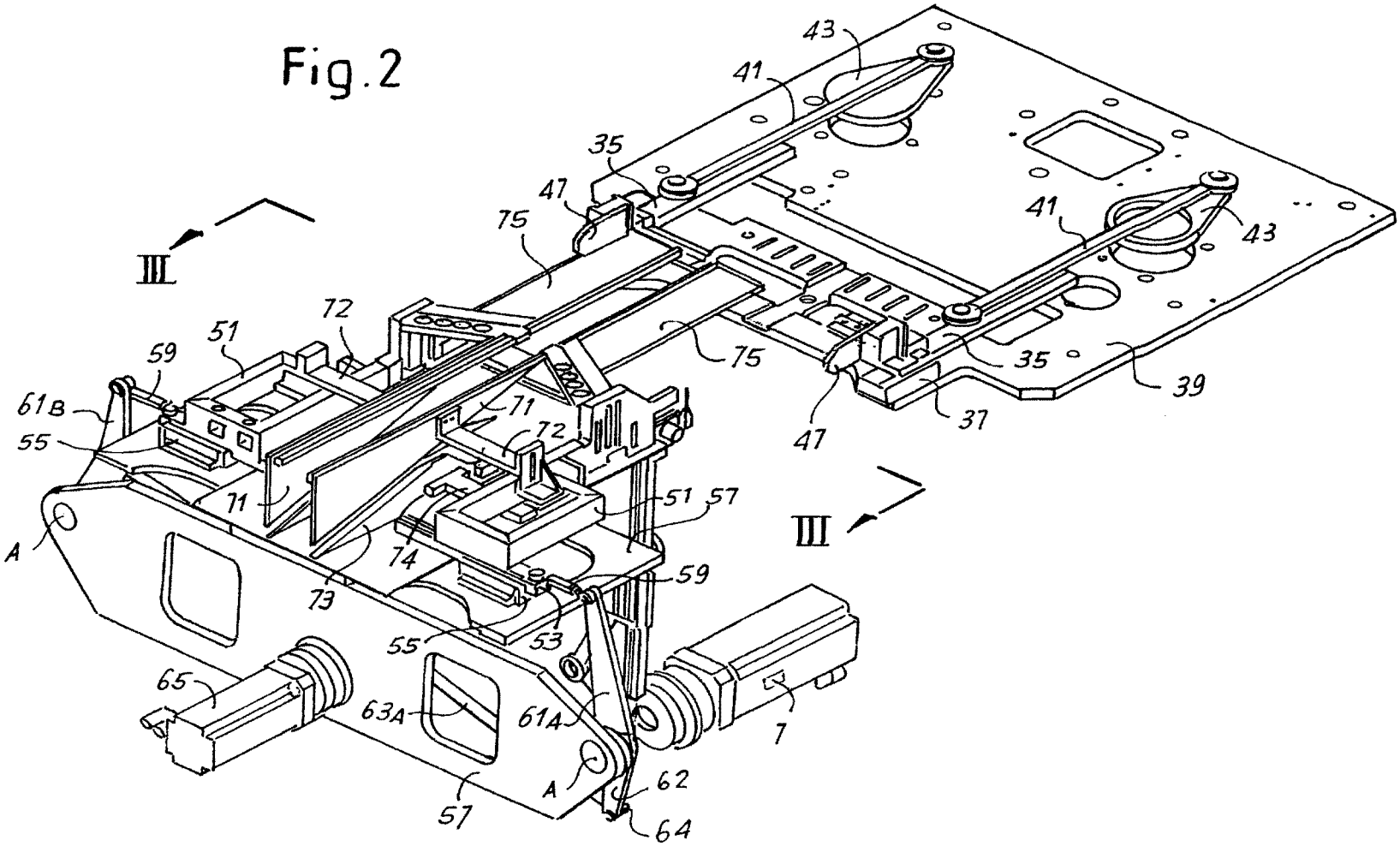
FIG. 2 shows an axonometric view of the folding members of the machine of FIG. 1, from which the parts above have been removed, and in particular the conveyor for feed of the rolls.
Figure 3:
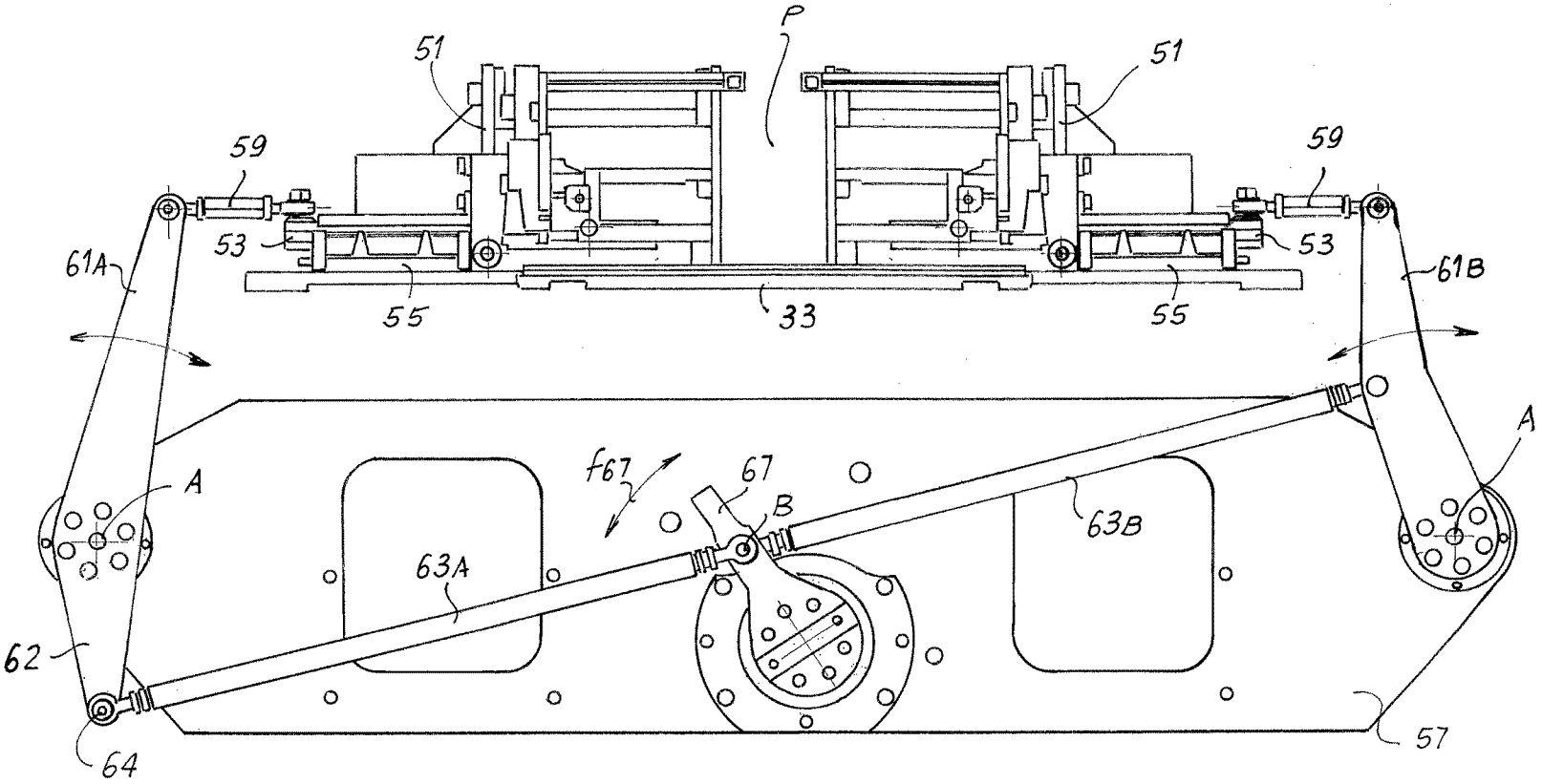
FIG. 3 shows a view according to III-III of FIG. 2.

In FIG. 1 the main machine members are shown. The load bearing structures, the casing, the parts of frame and other standard components have been omitted from the figure to highlight the functional and operating elements of the machine.

The machine, indicated as a whole with 1, comprises an insertion station 3 for inserting the rolls R. In this embodiment the insertion station 3 comprises an elevator 5 controlled by an actuator 7, for example an electronically controlled electric motor, interfaced with a control unit 9.

In this embodiment the rolls R reach the packaging machine 1 through a feed system, not shown, at a lower height with respect to the height at which the feed and packaging system of the rolls is located. The elevator 5 transfers the rolls from a lower level (at which they are fed by the feed system) towards the upper level, at which the members that perform packaging of the rolls are located. In the configuration illustrated the machine packages packs each comprising two rolls R aligned axially. It must be understood that the machine can be adjusted to produce packs of different shape and size. In particular, packs with several rolls placed side by side laterally, rather than aligned axially, can be formed, as will be explained hereunder with reference to the diagrams of FIGS. 5A-5G, which show the folding cycle of the wrapping sheet. Packs with several rolls aligned axially and several rolls placed side by side laterally can also be formed. Packs with several layers of rolls, each comprising two or more rows of rolls placed side by side with one another, each of which comprises a single roll or several rolls aligned axially, can also be formed.

Above the elevator 5 there is provided a conveyor, indicated as a whole with 11, which transfers the rolls lifted by the elevator 5 into the insertion station, towards a folding station indicated as a whole with 13.

In some embodiments the conveyor comprises two pairs of flexible members mutually parallel to one another. In particular, in the example illustrated the conveyor 11 comprises a first pair of flexible members 15 and a second pair of flexible members 17. In the example illustrated the flexible members 15 and 17 are constituted by chains, but it must be understood that it is also possible to use a different type of flexible members, such as belts and in particular toothed belts.

In the example illustrated, each flexible member 15 is driven around a pair of toothed wheels 19. In some embodiments one of the toothed wheels 19 of each flexible member 15 can be motorized. For example, two wheels 19 supported by a common shaft can be motorized, while the other two toothed wheels 19 can be idle.

The flexible members 17 are also driven each around a pair of toothed wheels 21. Also in this case one toothed wheel 21 for each flexible member 17 is motorized. For example, two coaxial toothed wheels 21 can be motorized, while the remaining wheels can be idle. In a known manner, the two pairs of flexible members 15, 15 and 17, 17 can be controlled by two electronically controlled electric motors interfaced with a unit 9. In normal operating conditions, the speed of the two motors is synchronous so that the two pairs of flexible members 15, 15 and 17, 17 are fed at the same speed. The angular phase between the two pairs of flexible members 15, 15 and 17, 17 and the respective idle and motorized guide wheels can be adjusted by changing the phase between the position of the two motors that drive the two pairs of flexible members, for the purposes that will be explained hereunder. For example, adjustment can be obtained by holding the flexible members 15, 15 still and moving the flexible members 17, 17 forward by a desired amount, corresponding to the change in phase to be imparted between the two pairs of flexible members. In other embodiments, there can be provided a manual phasing system of the two pairs of flexible members 15, 15 and 17, 17. For example, the four coaxial return wheels can be mounted in pairs and the pair of wheels associated with the flexible members 15, 15 can be angularly staggered with respect to the pair of toothed wheels associated with the flexible members 17, 17 and the wheels can be selectively locked and released to enable adjustment of the angular phase and therefore mutual torsional constraint between said wheels. In this case the conveyor 11 requires only one motor to control the four flexible members 15, 15, 17, 17.

Between the flexible members 15 there are arranged cross-members 23 engaged with the respective ends thereof to the two flexible members 15 mutually parallel to one another. Similarly, between the flexible members 17 there are arranged cross-members 25, each constrained with the ends thereof to the flexible members 17. Each cross-member can advantageously be formed by a pair of bars mutually parallel to one another.

In the configuration described here, the cross-members 23 and 25 are arranged in pairs, so that a cross-member 25 constrained to the flexible members 17 is located at the side of each cross-member 23 constrained to the flexible members 15. Fingers 27 are fastened to all the cross-members 23. In the example shown in the figures, three fingers 27 are fastened to each cross-member 23. The mutual distance between the fingers 27 can be adjustable. A method and a device for adjusting the mutual position of the fingers 27 are described, for example, in U.S. Pat. No. 7,789,219. Similarly, fingers 29 are fastened on each cross-member 25. In the example illustrated, there are provided three fingers 29 for each cross-member 25. The fingers 29 can also be adjusted with respect to one another as described with reference to the fingers 27.

The fingers 27 and 29 associated with each pair of cross-members 23, 25 placed side by side define seats 31 for receiving and advancing groups of rolls R to be packaged. The distance between the cross-members 23, 25 of each pair is adjustable by changing the angular phase of the position between the flexible members 15, 15 and 17, 17 so as to adjust the width of each seat 31 as a function of the size of the rolls R and of the number of rolls R placed side by side in each pack. The position of the fingers 27 on the cross-member 23 and of the fingers 29 on the cross-member 25 is also adjusted as a function of the size of the rolls and of the number of rolls aligned axially in each pack.

A sliding table 33 for the rolls engaged in the seats formed by the fingers 27, 29 extends below the conveyor 11. The sliding table 33 extends in the direction of feed F of the rolls along a feed path P under the lower branch of the flexible members 15, 17. The table 33 extends on one side of the insertion station 3 of the rolls R and along the folding station 13. A pair of moving carriages 35 sliding in guides 37 carried by a stationary structure 39 are located on the opposite side of said insertion station 3, i.e. on the opposite side with respect to the trajectory (arrow f1) of lifting of the rolls by the elevator 5. A pair of connecting rods 41 move the carriages 35 according to the double arrow f35 for the purposes described hereunder. The connecting rods 41 are moved by cranks 43 constrained to rotate about substantially vertical axes and carried by rotating shafts supported by the structure 39. Each crank-connecting rod system 41, 43 transforms the rotational movement of the shafts of the cranks 43 into a translational movement according to f35 of each carriage 35. The rotational movement of the cranks 43 is imparted by a motorization system, indicated schematically with 44, represented only in FIG. 4 and omitted for clarity of the drawing in the remaining figures).

Each carriage 35 carries a moving folding profile 47 that folds a first flap of the wrapping sheet wrapped around the rolls R lifted by the elevator 5 pressing it against the corresponding front surface of the roll or of the group of rolls fed from the elevator 5 into the packaging machine.

In the illustrated embodiment, on the opposite side of the insertion station 3, associated with the sliding table 33, a group of members is arranged, which fold the flaps of the wrapping sheet during feed of the roll or rolls R by the conveyor 11. As shown in particular in FIGS. 1 and 4 and in the detail of FIG. 2, two opposed symmetrical frames 51 are arranged at the sides of the feed path P of the rolls and above the sliding table 33.

In the embodiment illustrated, each frame 51 is carried by a slide 53 sliding in a respective guide 55 integral with a stationary load-bearing structure 57. In the embodiment illustrated, each slide 53 is constrained through a tie rod 59 to a respective rocker arm 61A and 61B. The two rocker arms 61A, 61B positioned at the two sides of the feed path P of the rolls are pivoted about an axis A parallel to the direction of feed F of the rolls engaged by the conveyor 11. The rotational movement of the two rocker arms 61A, 61B is symmetrical and is transmitted by means of bars 63A, 63B by an electric motor 65 fastened to the structure 57, to which the supports of the rotation shafts of the rocker arms 61A, 61B are also fastened. As can be seen in particular in FIG. 3, the two rocker arms 61A, 61B are shaped differently to one another. More in particular, the rocker arm 61A extends from the opposite part of the rotation axis A with respect to the tie rod 59 to form an extension 62, to which the end of the respective bar 63A is pivoted in 64. Vice versa, in the rocker arm 61B, the bar 63B is pivoted in 66 in an intermediate position between the axis A and the constraining point of the tie rod 59. The ends of the bars 63A, 63B opposite the ends constrained to the rocker arms 61A, 61B are pivoted, about a common axis B parallel to the axes A, to an oscillating arm 67. Oscillation of the arm 67 according to the double arrow f67 is imparted by the motor 65. The arrangement described enables symmetrical movements to be imparted to the rocker arms 61A, 61B by rotating the motor 65.

In the arrangement illustrated in FIGS. 1 to 5, the motor 65 remains inoperative during operation of the machine and is used only to perform an initial adjustment of the mutual position of the slides 53 guided in the guides 55. This adjustment enables adjustment of the distance between the frames 51 and the folding members associated therewith and described hereunder. In this way it is possible to adapt the machine to various dimensions of the groups of rolls R to be packaged and more in particular it is possible to adjust the structure of the machine as a function of the axial length of the rolls R aligned in each pack to be packaged.

The frames 51 support a series of first stationary folding members that are used to fold the flaps of the wrapping sheet against the front surfaces of the rolls of each pack.

More in particular, in the example illustrated these stationary folding members comprise a first upper folding profile 71. Moreover, in the example shown in the drawing, there is provided a second lower profile 73. The profiles 71 and 73 are known and commonly used in packaging machines that only produce packs packaged by folding and sealing the lateral flaps against the front surfaces of the rolls. A description of the shape and of the function of the folding profiles 71 and 73 can therefore be omitted. The patent publications cited in the introduction of the present description provide some embodiments of possible stationary folding profiles that can be used.

In the embodiment illustrated, the stationary profiles 71 and 73 are carried by means of brackets 72 and 74 by the respective frame 51. The brackets 72 and 74 can be adjustable both in a vertical direction and in a horizontal direction and transverse to the direction of feed F of the rolls through the machine, to adapt to the shape and to the dimension of the pack.

In some embodiments, upstream of the profiles 71, 73, there can be positioned guide plates 75, constrained to the respective frame 51 to contain, at the top, the rolls and the related wrapping sheets that are drawn upward by the rolls during insertion by the elevator 5 into the insertion station. The mutual distance in horizontal and transverse direction with respect to the direction of feed F of the rolls of the profiles 71, 73 and of the plates 75 is obtained by acting by means of the motor 65 to set the distance between the frames 51.

Figure 4:
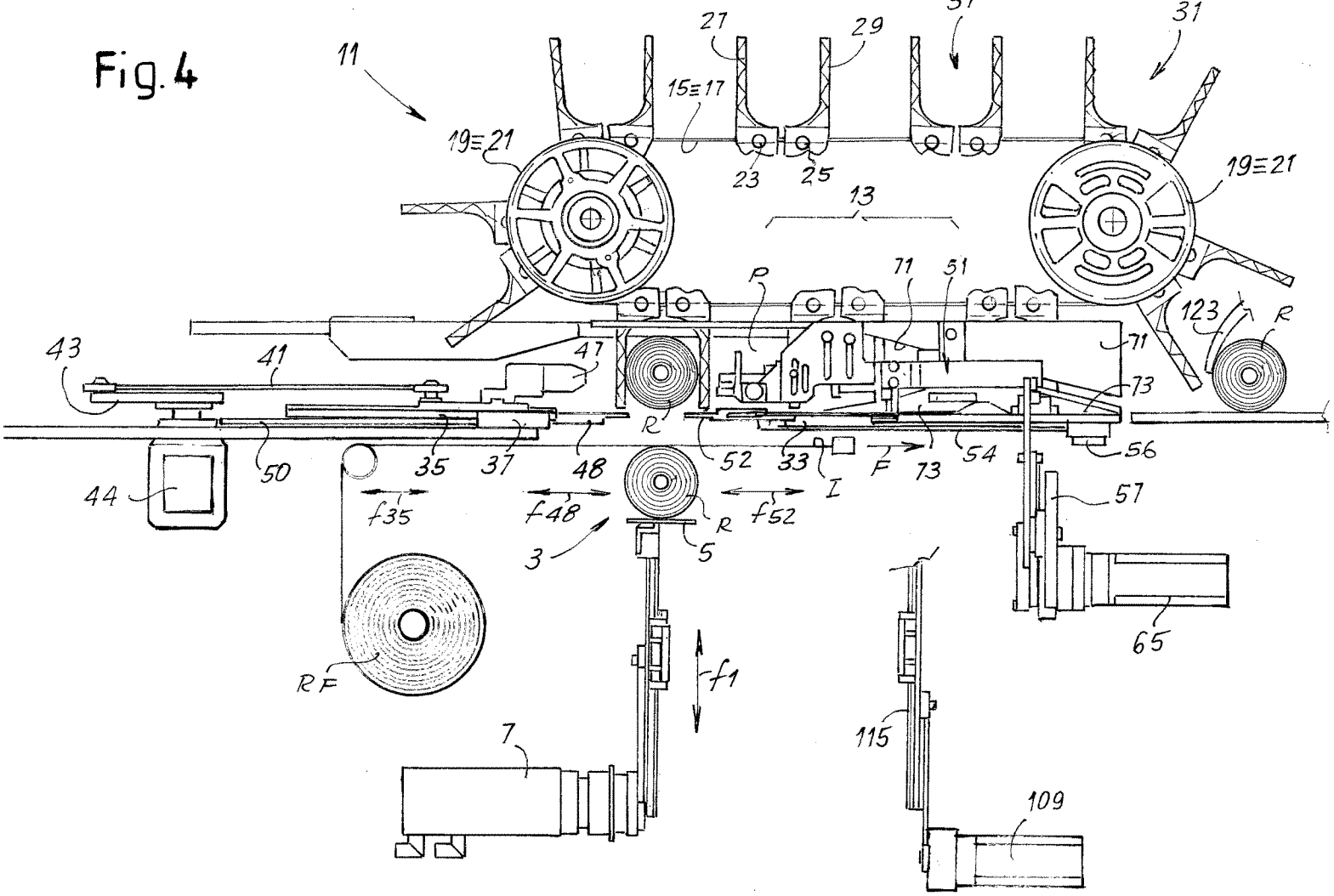
FIG. 4 shows a side view of the machine of FIGS. 1 to 3.
Figure 5:
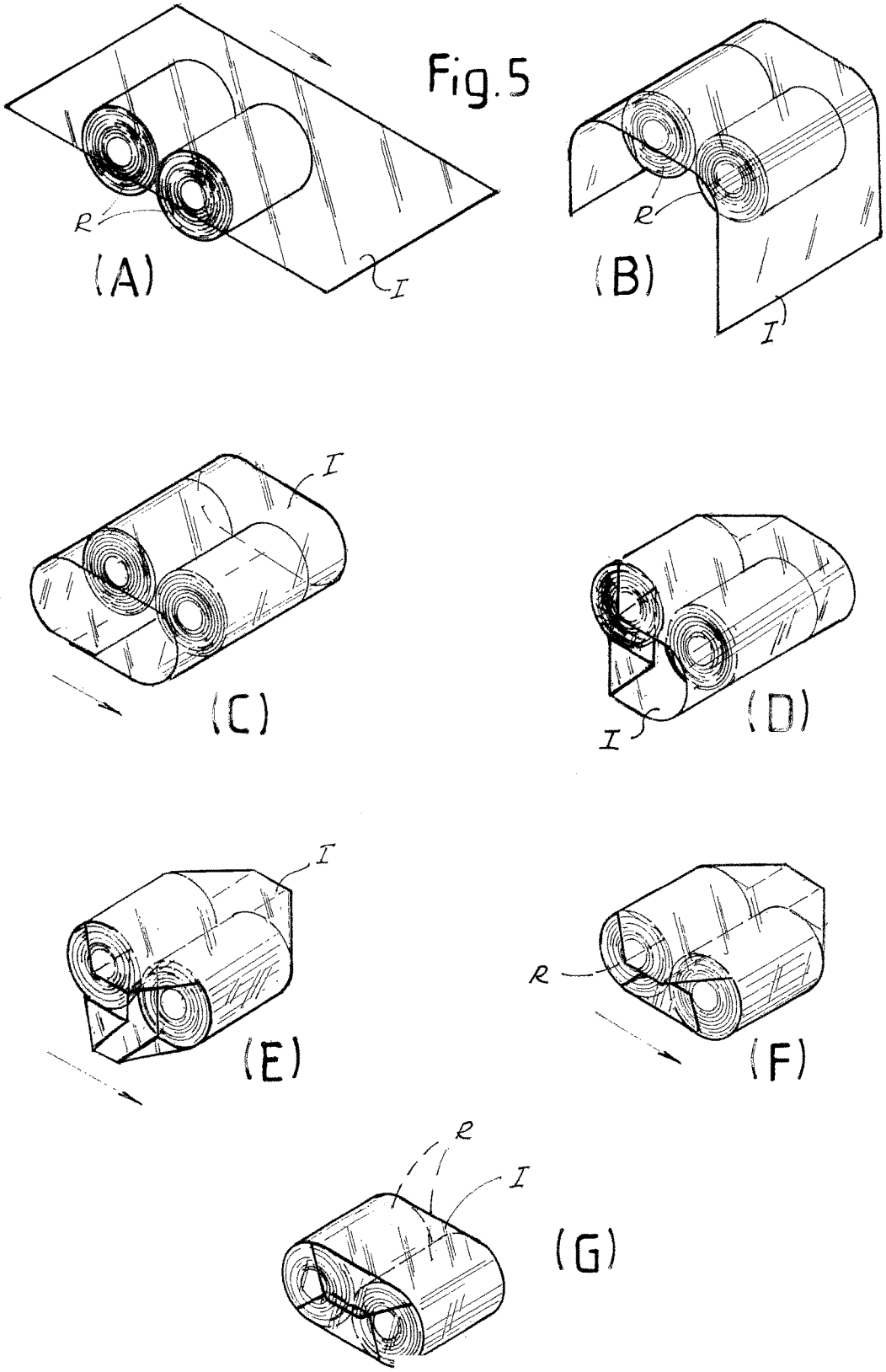
FIGS. 5A-5G show the steps of folding the wrapping sheet performed by the machine of FIGS. 1 to 4.

In addition to the members described above, the machine comprises a pair of horizontal moving folding tables which have been omitted in some figures for greater clarity of the drawing and which are represented in particular in the side view of FIG. 4. This figure shows a first horizontal movable table 48 provided with a movement parallel to the movement f35 of the carriages 35 and of the moving folding profiles 47 to move towards and away from the insertion station of the rolls. The movement of the horizontal movable table 48 can be imparted by a crank-connecting rod system, indicated schematically with 50, equivalent to the system 41, 43, with a motor similar to the motor 44. The movement of the movable folding table 48 is synchronized with the movement of the carriages 35 and of the moving folding profiles 47 in the manner described hereunder. On the opposite side with respect to the trajectory of the elevator 5 and approximately at the same height as the table 48, there is positioned is a second horizontal movable folding table 52, movable according to f52 and controlled by a crank-connecting rod system or similar motion transmission system 54 and by a motor 56. The horizontal movable folding table 52 is provided with a movement to move towards and away from the insertion station of the rolls. This movement of the movable folding table 52 is synchronized with the movement of the folding profiles 47 and of the movable folding table 48.

The machine described above and setup in the manner illustrated in the aforesaid figures can produce conventional packs in which the wrapping sheet is folded with the lateral flaps thereof sealed on the front faces of the rolls of the packs.

The folding procedure will be described below with reference also to FIGS. 5A-5G, which schematically show a group of rolls R to be packaged and the related wrapping sheet I.

FIGS. 1 to 4 show groups with two rolls each, wherein the rolls of each group are axially aligned. In the sequence of FIGS. 5A-5G, each group again has two rolls, but placed side by side laterally. These are only two of the many possible configurations of the pack that can be obtained by adapting the machine.

The wrapping sheet I is arranged in the machine through known means arranged in the insertion station 3. These means are indicated schematically in FIG. 4. and omitted in the remaining figures. The sheet I is advantageously obtained by cutting a roll of plastic film RF positioned in the lower part of the machine. In the diagram of FIG. 4, the roll RF is positioned with the axis thereof orthogonal to the direction of feed F of the rolls R to be packaged. However, this position is only indicative, as the roll RF could also be positioned with the axis thereof parallel to the direction of feed F.

When the elevator 5 lifts a roll or a group of rolls towards the level of the conveyor 11, the wrapping sheet I is drawn upward by the group of rolls and wraps them on three sides, as shown in FIG. 5B. The roll is located between the fingers 27, 29 in the seat that was positioned above the elevator 5. At this point, movement towards the elevator 5 of the movable folding table 48 and of the folding profiles 47 causes folding of the portion of wrapping sheet I located under the roll and a first vertical folding on each side of the rolls. Forward movement of the second horizontal folding table 52 causes folding of the second vertical flap of the wrapping sheet I and at the end of this first step the group of rolls R is in the conditions shown in FIG. 5D. It must be understood that the three folds made up to this point by means of the tables 48, 52 and by means of the moving profiles 47 can be carried out with a sequence that may vary according to cases and to needs. In fact, these three members are controlled by actuators that are independent from one another, the mutual reciprocal phasing can be controlled by the control unit. For example, it is possible to make the first fold by means of the horizontal tables 48, 52 and only subsequently the vertical fold by means of the moving profiles 47. Alternatively, the profiles 47 and the table 48 can act simultaneously and the table 52 can be delayed. In another alternative, the three movements can all be staggered in time one with respect to the other.

After performing these operations, the conveyor 11 moves forward making the roll R pass between the stationary profiles 71, 73 and further vertical folding profiles, not shown, which perform vertical folding and the horizontal folding of the flaps of wrapping sheet I projecting from the group of rolls, as shown in FIG. 5E (vertical fold) and in the subsequent FIGS. 5F, 5G. This procedure is known and does not require detailed description. In the step to feed the roll R from the position above the elevator 5 towards the folding station, the horizontal movable folding table 52 performs a reverse movement synchronized with the forward movement of the conveyor 11, so as to accompany the roll towards the stationary folding profiles 71, 73.

At the end of the procedure, the group of rolls R leaves the folding station with the wrapping sheet I folded as shown in FIG. 5G and is made to pass through a sealing station, which seals the folded flaps. The sealing station is known and not illustrated and can be configured, for example, as described in the patent literature cited in the introduction of the present description.

FIGS. 6 to 10D show the same machine configured for manufacturing individual packs by means of wrapping sheets, the flaps of which are inserted inside the hole of the central tubular core on which the single rolls R are wound. The wrapping sheets are preferably made of paper material rather than plastic and are therefore not sealed. As will be apparent hereunder, the packaging system is in this case similar to the "Twist-and-Tuck" system mentioned in the introduction of the description, but with some important ameliorative differences.

In FIGS. 6 to 10D the same numbers indicate parts identical or corresponding to those used in the configuration described previously.

Figure 6:
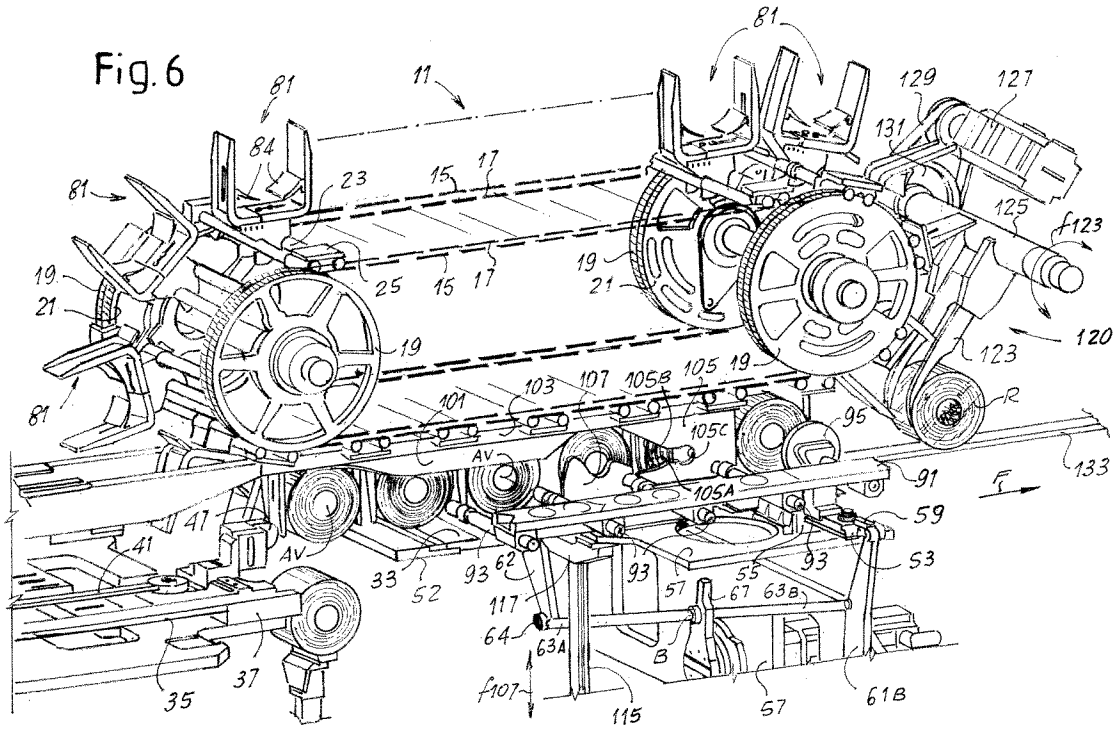
FIG. 6 shows an axonometric view of the machine configured to produce rolls packaged with the twist-and-tuck system.
Figure 7:
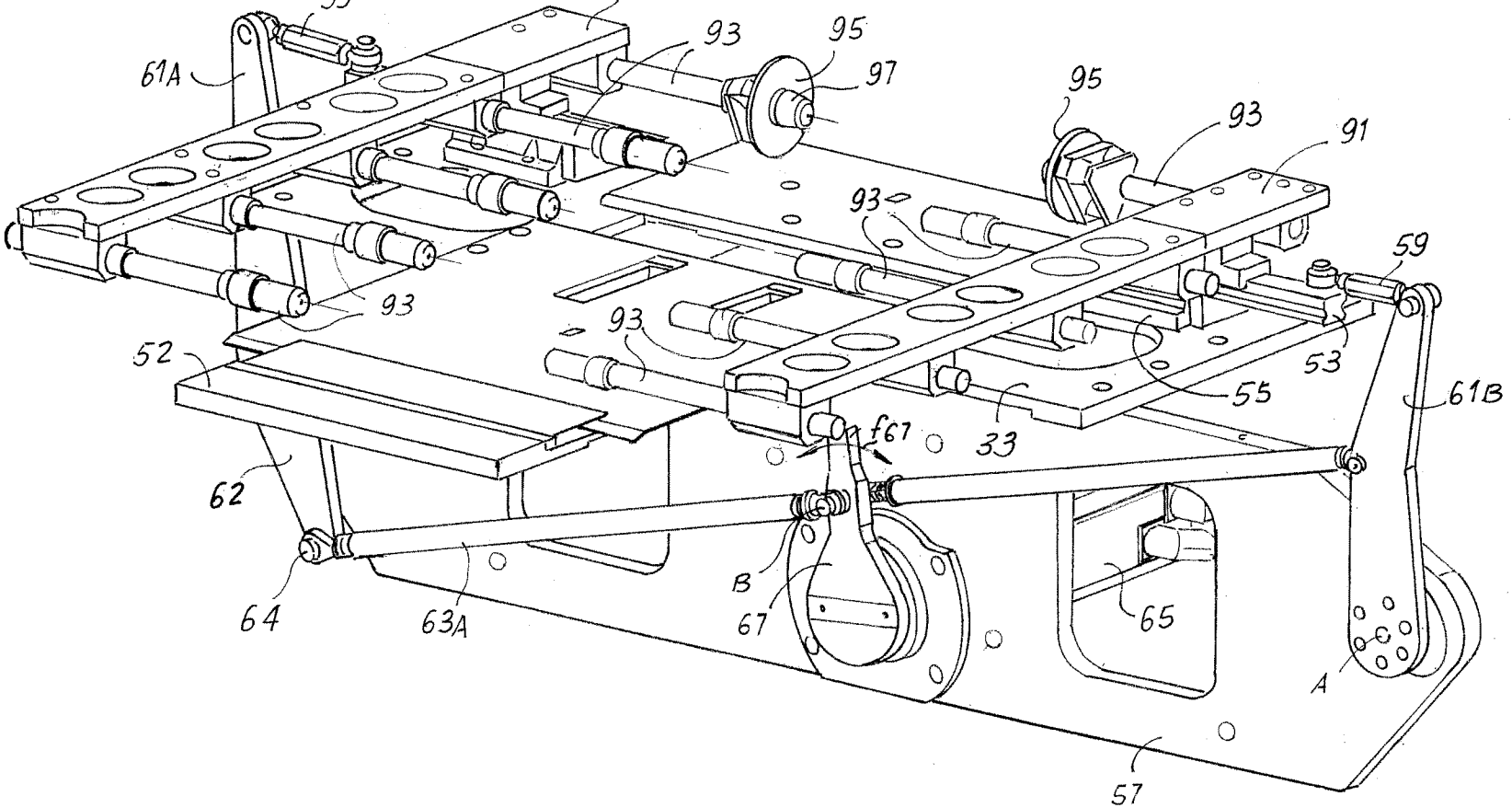
FIG. 7 shows an axonometric view of the folding members of the folding station of the machine in the configuration of FIG. 6.
Figures 8, 9:
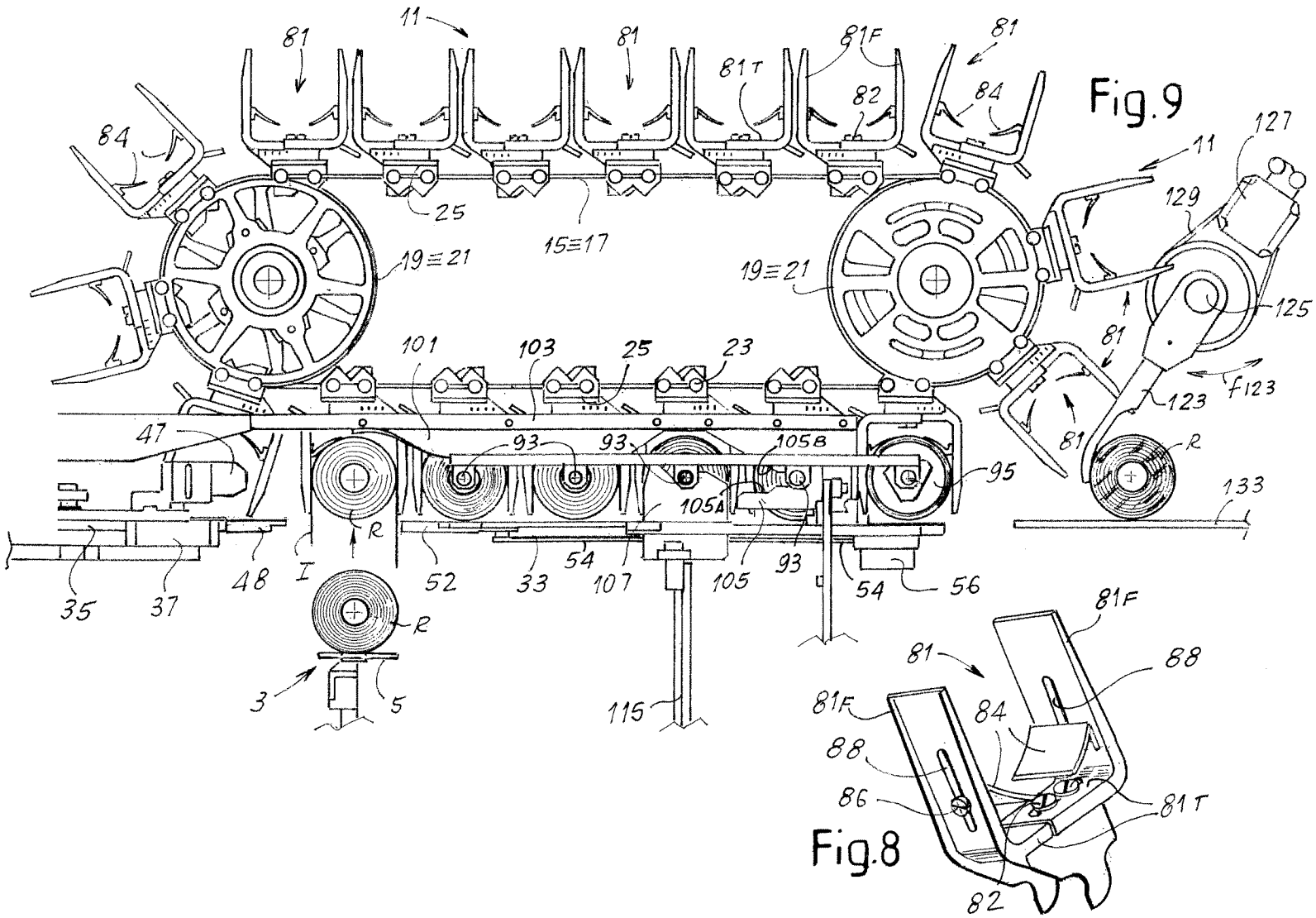
FIG. 8 shows a detail of a seat for containing the rolls in the machine configured as in FIGS. 6 and 7)
FIG. 9 shows a side view of the machine configured as in FIGS. 6 to 8.
Figure 10:
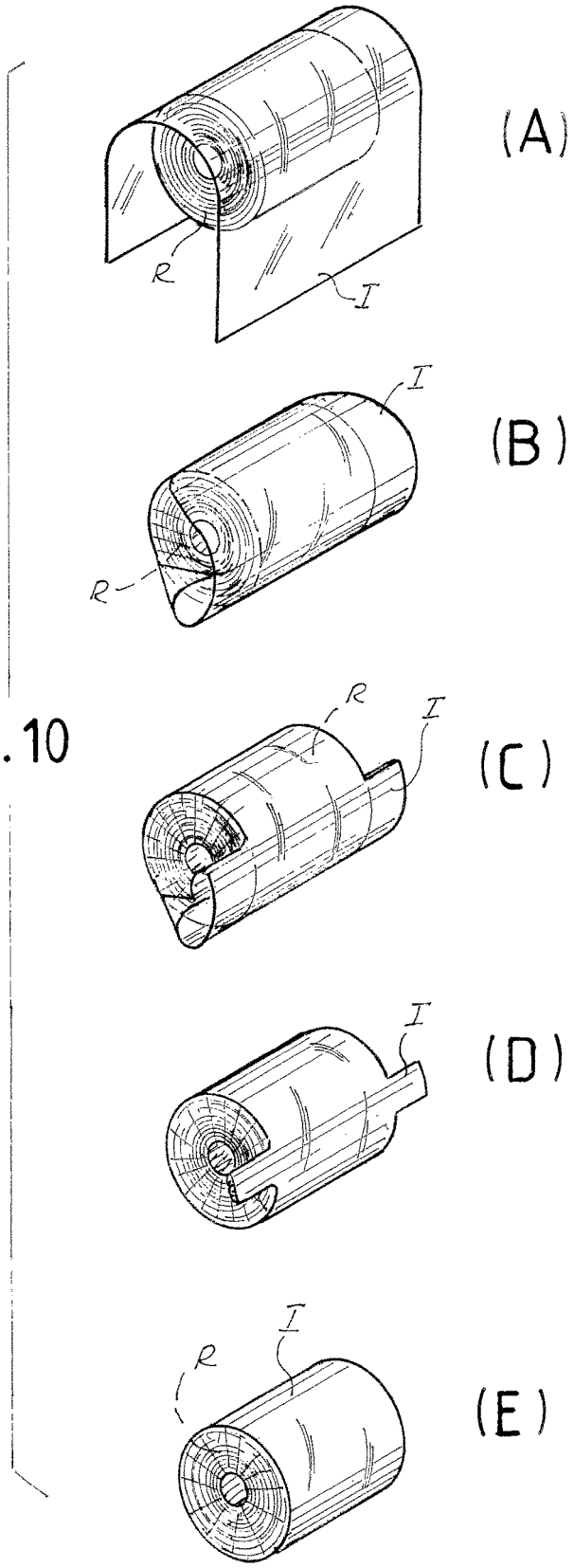
FIGS. 10A-10E show a sequence of the folding procedure performed by the machine configured as in FIGS. 6 to 9.

As can be observed in FIGS. 6 and 9, in this configuration the two pairs of flexible members 15, 15 and 17, 17 have been phased in such a manner that the cross-members 23 constrained to the pair of flexible members 15, 15 are intercalated and equidistant with respect to the cross-members 25 constrained to the flexible members 17, 17. A respective seat 81 is fastened to each cross-member 23 and to each cross-member 25. The seats 81 substitute the fingers 27 and 29. The seats 81 are equidistant from one another. The pitch between consecutive seats 81 is equal to the distance between the cross-member 23, 25 of each pair of consecutive cross-members.

In the example illustrated, each seat 81 has a substantially C-shaped structure with a cross-member 81T from which two side members 81F extend. In some embodiments one of the two side members 81F is produced in one piece or fixed with respect to the cross-member 81T, while the other side member is adjustable and can be blocked on the cross-member 81T at a distance that is adjustable with respect to the opposite side member. The number 82 indicates the screws for locking the side member 81F to the cross-member 81T. In this way, the width of each seat 81 can be adapted to the diameter of the rolls to be handled.

In some embodiments each seat 81 has shaped plates 84 defining containment surfaces of the rolls that are to be moved forward by the conveyor 11. In the illustrated embodiment, a respective plate 84, having an extension substantially smaller than the width of the single seat 81, projects from each side member 81F towards the inside of the seat 81. The plates 84 preferably have a curved roll contacting surface. The position of the plates 84 can be adjusted by means of a screw 86 and a slot 88 provided in each side member 81F. The position of the plates 84 is adjusted as a function of the diameter of the rolls R to be handled. In substance, therefore, the containment volume of each roll can be adjusted by modifying and adjusting the distance between the side members 81F and adjusting the position of the plates 84.

Below the conveyor 11 in the configuration illustrated in FIGS. 6 to 9 there is also arranged an assembly of members comprising the elevator 5 and the carriages 35 with the respective movement members and the folding profiles 47 carried by the carriages 35. On the opposite side of the insertion station, in which the elevator 5 moves, there is provided a different configuration of folding members.

More in particular, a beam 91 is fastened on each slide 53 in substitution of the respective frame 51. Each slide 53 is connected to the same kinematic members that transmit the movement from the motor 65 to the slides 53. However, as will be more apparent hereunder, in this configuration the motor 65 is not used to adjust the mutual position of the folding members, but rather to operate the same members with a reciprocating cyclic movement and obtain folding at each step of the conveyor 11.

Punches 93 are fastened to each beam 91. In the example illustrated, on each side of the feed path P of the rolls R there are provided four punches 93, carried by the respective beam 91. The punches 93 are mutually spaced apart by a constant pitch, if necessary adjustable, corresponding to the pitch of the rolls R housed in the single seats 81 integral with the conveyor 11. On each beam 91, downstream of the punches 93 with respect to the direction of feed F of the rolls R through the machine, there is arranged a disk-shaped member 95, projecting from the center of which is a pin or tip 97, preferably conical in shape. The distance between the pin or tip 97 and the adjacent punch 93 is equal to the pitch between the rolls R engaged in the seats 81 of the conveyor 11.

The synchronous and symmetrical movement of the rocker arms 61A and 61B causes a corresponding synchronous and symmetrical movement of the beams 91 with the respective punches 93 and the disk-shaped member 95 on the two sides of the feed path P of the rolls R transferred through the machine by the conveyor 11 for the purposes that will be explained hereunder. The movement of the beams 91 is synchronized with the forward movement of the conveyor 11.

A first stationary profile 101, which extends approximately parallel to the path of the rolls, is arranged between each beam 91 with the respective punches 93 and the feed path of the rolls. The stationary profile 101 can be carried by a stable structure of the machine, indicated with 103. A second stationary folding profile 105 is fastened to the same structure 103, on each side of the feed path of the rolls. The profile 105 has a shaped edge with two converging guide profiles, indicated with 105A and 105B, which connect with a substantially circular portion 105C of the edge of the profile 105. The converging edges 105A and 105B are facing in the direction from which the rolls arrive from the inlet station 3 and therefore converge in the direction of feed F of the rolls up to the circular portion 105C of the aforesaid edge.

A moving folding profile 107 is arranged on each side of the feed path P of the rolls R, between the stationary folding profiles 101 and 105. The two moving folding profiles 107 are provided with a movement according to the double arrow f107 in a substantially vertical direction, said movement being synchronized with the forward movement of the conveyor 11. In the exemplary embodiment illustrated, the lifting and lowering movement of the moving folding profiles 107 according to the double arrow f107 is imparted by a motor 109 positioned under the sliding table 33 of the rolls. In the example illustrated, the motor 109 controls, by means of a crank 111 and a connecting rod 113, the lifting and lowering movement of a rod 115, to which a cross-member 117 that carries the two moving folding profiles 107 is constrained.

The members described above perform a sequence of folding steps, which will be better understood also with reference to the sequence represented schematically in FIGS. 10A-10E, which show a roll and the related wrapping sheet in isolation, to illustrate the packaging process.

Each roll to be packaged is lifted by the elevator 5 and inserted into the respective seat 81, which is located above the trajectory of the elevator 5. In this step, a wrapping sheet I, preferably made of paper, wraps the roll R superiorly and laterally (FIG. 10A). The horizontal movable folding tables 48, 52 perform, in the manner already described with reference to the previous operating method, folding of the vertical flaps of the wrapping sheet, so as to arrange them under the roll R. The roll is thus completely wrapped in the wrapping sheet I which, being longer than the roll R, projects from both the flat faces of the roll. The forward movement of the horizontal folding table 48 is synchronized with the forward movement of the folding profiles 47, which fold a first part of the flaps of the wrapping sheet I, projecting with respect to the flat surfaces of the roll R, on said flat surfaces. At the end of this step the roll is as represented schematically in FIG. 10B.

If the stationary folding profile 101 extends with the initial, preferably rounded, edge thereof until it is above the elevator 5, in this first step the upper portion of the wrapping sheet is at least partially folded against the front surface of the roll. Preferably, as shown in the appended drawings, the stationary folding profile 101 is twisted in such a manner that in the initial part it does not fold the wrapping sheet, but only acts thereon in a subsequent step.

In the subsequent step, the conveyor 11 moves the roll R forward according to the arrow F, while the horizontal movable folding table 52 performs a movement synchronized and concordant with the movement of said conveyor 11.

The conveyor 11 moves forward stepwise so as to carry each roll R inserted in the respective seat 81 and around which the wrapping sheet I has been wrapped, in front of each punch 93 and in front of the disk-shaped member 95, making each roll stop in each position corresponding to the punches 93 and to the disk-shaped member 95 to perform the operations described hereunder. It must be understood that normally in each moment of the packaging cycle all the seats 81 of the conveyor 11 are full and therefore at each step of forward movement of the conveyor 11 each punch 93 and the disk-shaped member 95 perform an operation on a different roll R.

The stepwise forward movement of the conveyor 11 is synchronized with the alternated movement of the two beams 91 and therefore of the two series of punches 93 and of the disk-shaped members 95 arranged respectively on the two sides of the feed path P of the rolls R. This alternated movement is controlled by the electric motor 65 and coordinated with the lifting and lowering movement of the moving folding profiles 107 controlled by the electric motor 109.

As stated, all the seats 81 are normally full and each punch 93 performs an operation at each step on subsequent rolls. In the description below, a single roll will be considered and the operations performed thereon by the various machine members will be described, it being understood that these operations are performed in sequence on each roll engaged in the seats 81 of the conveyor 11.

In the first step of forward movement of the roll R, after it has been inserted in the seat 81 located above the elevator 5, the roll is made to pass between the two opposite stationary folding profiles 101. If these are twisted, the downward fold of the upper part of the projecting flap of the wrapping sheet I is started. Preferably, the folding operation is completed when the roll is located between the punches 93 of the second pair, as described hereunder. In some embodiments, the stationary profile 101 can be shorter than the one represented in the drawing and start downstream of the position taken by the roll that has just been lifted by the elevator 5, so as to start folding the upper part of the wrapping sheet only after the roll R has started to move forward according to F along the feed path P. In other embodiments the stationary folding profile 101 can have the length represented in the drawing, and be flat, in which case downward folding of the upper part of the flap of wrapping sheet starts immediately, when the roll R is inserted in the seat 81 by the elevator 5. In further embodiments, the stationary folding profile 101 can have a variable height, with a lower edge that is lowered gradually, to obtain gradual folding of the flap of wrapping sheet.

When the roll has performed the first step of forward movement and is located between the punches 91 of the first pair, it is stopped temporarily, enabling partial insertion of the punches inside the axial hole of the winding core AV of the roll. In this way, the punches 93 fold the portion of wrapping sheet I, which on each front surface of the roll was folded by the moving folding profiles 47 against the respective front surface until it was over the tubular core AV, inside the tubular winding core AV.

Moving forward by a further step, the roll R is located between the punches 93 of the second pair, after the upper part of the flap of wrapping sheet projecting from each of the two front surfaces of the roll R has been folded downward by the respective stationary folding profile 101. The alternate movement of insertion and subsequent extraction of the punches 93 of this pair causes insertion of the respective portion of folded flap into the tubular core AV (FIG. 10C).

Once the punches 93 have been moved away from the roll, the latter moves forward by a further step and is located at the two opposite moving folding profiles 107, which have been lowered to position the roll and are axially aligned with the punches 93 of the third pair of punches. If necessary, the forward movement of the rolls R and the lowering movement of the moving folding profiles 107 can be coordinated so that the roll moves forward between the two moving folding profiles 107 which have been taken to the lifted position, to fold a part of the projecting flaps against the flat surfaces of the roll. Subsequently, the profiles 107 can be lowered and lifted again to fold the lower part of the flaps of wrapping sheet I against the flat surfaces of the roll R. Preferably however, the moving folding profiles 107 are lowered under the roll feed table before the roll arrives. When the latter stops in the position corresponding to the moving folding profiles 107, these are lifted to fold the lower portion of the flap of wrapping sheet projecting from the respective front surface of the roll R upward, pressing it against this surface and carrying it in front of the tubular winding core AV.

The lifting movement according to f107 of the moving folding profiles 107 is synchronized with respect to the transverse movement of the punches 93 carried by the beam 91, in such a manner that the punches 93 of the third pair of punches are inserted in the hole of the winding core AV which is located between the moving folding profiles 107 after said moving folding profiles 107 have been lifted. In this way one part of the flap of the wrapping sheet is inserted inside the winding core AV. At this point the roll is in the condition schematically shown in FIG. 10D.

In the subsequent step, the roll R moves forward between the two stationary folding profiles 105 that fold the remaining portions of the flaps of wrapping sheet against the front surfaces of the roll, which are then inserted inside the axial hole of the winding core AV with a further insertion movement of the last pair of punches 93. At this point the roll is completely wrapped and the flaps of the wrapping sheet I have been overturned against the flat surfaces of the roll R and inserted inside the tubular core AV (FIG. 10E).

The subsequent forward movement step carries the roll between the two disk-shaped members 95 and the central conical pins or tips 97 positioned on said disk-shaped members. The movement of the disk-shaped members 95 towards one another and the penetration movement of the conical pins 97 into the ends of the central tubular winding core AV stabilizes the folds of the wrapping sheet I around the roll R.

The final pack that is obtained is similar to that obtainable with the packaging machines of the twist-and-tuck type known from the prior art described in the introduction of the present description. However, the method performed by the machine described here is different from those mentioned above, as there is no twisting or torsion of the projecting flaps of the wrapping sheet and subsequent insertion into the tubular winding core in a single operation by means of a single punch. On the contrary, the machine of the invention, in this embodiment, gradually folds each wrapping sheet, overturning a portion of sheet against the lateral surface of the roll at each step of the roll and inserting only a part of the flap of folded sheet inside the tubular winding core AV at each step. The "tuck" process, i.e. insertion of the sheet into the winding core by means of a punch is therefore divided into a series of subsequent steps, using in sequence for each side of the roll four punches, each of which acts on the same roll, one at each step. Insertion of the folded flap of the wrapping sheet into the tubular winding core AV is therefore much more gradual, which reduces the risk of tearing of the sheet during packaging of the roll R.

The subsequent step of forward movement of the conveyor 11 carries the packaged roll to an extractor 120 (shown in particular in FIGS. 6 and 9), provided to extract the roll R from the respective seat 81. In fact, this latter does not allow the roll to fall freely when the seat starts the lifting movement around the return wheels 19, 21 downstream of the folding station, as the side members 81F of the seat are rigidly connected to the cross-member 81T. The extractor 120 provided for the purpose of extracting the roll from the seats can comprise a pair of prongs 123 which have, in the example illustrated, a curved structure to follow the shape of the lateral surface of the rolls. The prongs 123 are positioned at a reciprocal distance, which can be adjustable if required, such as to be able to pass externally and laterally to the side members 81F of each seat 81. The prongs 123 are fastened torsionally to a shaft 125 provided with a reciprocating rotation movement controlled by an electric motor 127 and transmitted by means of the belt 129 to a pulley 131 fitted onto the shaft 125. The reciprocating rotation according to the arrow f123 controlled by the motor 127 at each step of the conveyor 11 ensures that each packaged roll R delivered from the folding station is engaged at the ends thereof projecting from the seat 81 by means of the two prongs 123, which extract the roll R and drop it onto an exit path 133.

When the machine is configured as described with reference to FIG. 6 and following, the sealing station downstream (not shown), which in the arrangement of FIGS. 1 to 5 has the function of sealing the folded flaps of the plastic packaging film, is used as simple transfer or conveyor device, maintaining the heating systems switched off and using only the conveying members, for example with a web or with belts.

It is understood that the drawing shows just one example, provided merely as a practical demonstration of the invention, which can vary in its forms and arrangements, without however departing from the scope of the concept underlying the invention. Any reference numbers in the appended claims are provided to facilitate reading of the claims with reference to the description and to the drawing, and do not limit the scope of protection represented by the claims.

The invention claimed is:

1. A packaging machine for packing rolls of paper comprising:

an insertion station for inserting the rolls in wrapping sheets;

a feed path for the rolls;

a conveyor to feed the rolls along said feed path;

a folding station adapted to be equipped alternatively (a) with first stationary folding members to fold lateral flaps of said wrapping sheets against end surfaces of said rolls; or (b) with second dynamic folding members, to insert lateral flaps of said wrapping sheets inside holes of respective winding cores of said rolls;

wherein said folding station comprises a first slide and a second slide arranged at the sides of said feed path and movable according to a direction of movement, transverse with respect to the feed path, and at least one actuator to move said first slide and said second slide along said direction of movement, wherein at least some of the first stationary folding members or of the second dynamic folding members are selectively constrainable to said first slide and said second slide; and wherein when said folding station is equipped with said first stationary folding members, said first slide and said second slide are maintained in a stationary position during packaging, and said at least one actuator being controlled to adjust the distance between said first stationary folding members.

2. The machine according to claim 1 wherein said insertion station comprises an elevator which transfers said rolls from a lower level to an upper level and members for applying said wrapping sheets around said rolls during transfer.

3. The machine according to claim 1 wherein when said folding station is equipped with said second dynamic folding members, said first slide and said second slide are controlled by said at least one actuator to move towards and away from each other synchronized with a stepped forward movement of said conveyor.

4. The machine according to claim 1 wherein said actuator is connected through first and second mechanical connection members to said first slide and to said second slide, said first and second mechanical connection members being designed and arranged to control symmetrical movements of said first slide and said second slide by means of said actuator.

5. The machine according to claim 1 wherein when said folding station is equipped with said first stationary folding members, said first stationary folding members comprise, on each side of the feed path, two folding profiles extending from a bottom upward and from a top downward, adapted to fold and press portions of said wrapping sheet against respective front surfaces of the rolls.

6. The machine according to claim 1 wherein when said folding station is equipped with said second dynamic folding members, said second dynamic folding members comprise, on each side of the feed path, at least a first stationary folding profile, extending towards the insertion station; and wherein said second dynamic folding members further comprise, on each side of the feed path, a plurality of mutually spaced apart punches to insert the flaps of the wrapping sheet into the winding core of the rolls, as well as a pair of disk-shaped members, arranged downstream of said spaced apart punches.

7. The machine according to claim 6 wherein said first stationary folding profile is positioned and configured to fold an upper portion of the wrapping sheet projecting laterally from the roll downwards.

8. The machine according to claim 1 wherein said conveyor extends above said first slide and said second slide.

9. The machine according to claim 8 wherein said conveyor extends from the insertion station to beyond the folding station.

10. The machine according to claim 8 wherein said conveyor comprises a plurality of seats, each seat receiving a roll in the insertion station and transferring said roll through the folding station.

11. The machine according to claim 1 wherein said conveyor comprises a first pair of flexible members and a second pair of flexible members, parallel to one another, said first pair of flexible members and said second pair of flexible members adapted to be driven around idle and motorized wheels, an angular phase of said first pair of flexible members and of said second pair of flexible members being adjustable.

12. The machine according to claim 11 wherein a first series of cross-members is constrained to said first pair of flexible members and a second series of cross-members is constrained to said second pair of flexible members.

13. The machine according to claim 12 wherein the first series of cross-members and the second series of cross-members can be positioned in such a manner that each cross-member of the first series is placed side by side with a corresponding cross-member of the second series, to define, in combination with respective first fingers and second fingers constrained to said cross-members, a seat to contain and feed the rolls, the dimension of said seats being adjustable by adjusting the angular phase between said first pair of flexible members and said second pair of flexible members.

14. The machine according to claim 12 wherein the first series of cross-members and the second series of cross-members can be positioned in such a manner as to be spaced apart by a constant pitch and wherein a seat formed by a substantially C-shaped structure, with a cross-member and two side members, can be constrained to each of said cross-members, to contain and feed single rolls engaged in said seat.

15. The machine according to claim 14 wherein the distance between said two side members is adjustable as a function of a diameter of the rolls.

16. The machine according to claim 14 wherein each one of said seats comprises roll containment surfaces extending from said side members towards an inside of the respective seat.

17. The machine according to claim 14 further comprising an extractor positioned downstream of the folding station and cooperating with said conveyor to extract the rolls from the conveyor, and wherein said extractor comprises a fork structure with two prongs which are placed side by side with each seat to engage and extract from the seat each roll inserted in said seat.

18. The machine according to claim 1 further comprising an extractor positioned downstream of the folding station and cooperating with said conveyor to extract the rolls from the conveyor.

19. The machine according to claim 18 wherein said extractor is provided with a rotational movement around an axis substantially orthogonal to a direction of forward movement of the conveyor and synchronized with the forward movement of said conveyor.

20. The machine according to claim 1 wherein when said folding station is equipped with said second dynamic folding members, the conveyor is controlled to move forward stepwise, each step of the conveyor corresponding to a folding movement of said second dynamic folding members.

21. The machine according to claim 1 wherein arranged on a side of the insertion station opposite the folding station are moving folding profiles, provided with a movement to move towards and away from the insertion station.

22. The machine according to claim 1 wherein associated with said insertion station are two movable tables, provided with movement to move towards and away from the insertion station, to wrap a wrapping sheet around each roll inserted in the insertion station.

23. A packaging machine for packing rolls of paper comprising:

an insertion station for inserting the rolls in wrapping sheets;

a feed path for the rolls;

a conveyor to feed the rolls along said feed path;

a folding station adapted to be equipped alternatively (a) with first stationary folding members to fold lateral flaps of said wrapping sheets against end surfaces of said rolls; or (b) with second dynamic folding members, to insert lateral flaps of said wrapping sheets inside holes of respective winding cores of said rolls;

wherein said folding station comprises a first slide and a second slide arranged at the sides of said feed path and movable according to a direction of movement, transverse with respect to the feed path, and at least one actuator to move said first slide and said second slide along said direction of movement, wherein at least some of the first stationary folding members or of the second dynamic folding members are selectively constrainable to said first slide and said second slide; and wherein when said folding station is equipped with said first stationary folding members, said first stationary folding members comprise, on each side of the feed path, two folding profiles extending from a bottom upward and from a top downward, adapted to fold and press portions of said wrapping sheet against respective front surfaces of the rolls, and wherein said two folding profiles on each side of the feed path are constrained to a respective one of said first slide and said second slide.

24. A packaging machine for packing rolls of paper comprising:

an insertion station for inserting the rolls in wrapping sheets;

a feed path for the rolls;

a conveyor to feed the rolls along said feed path;

a folding station adapted to be equipped alternatively (a) with first stationary folding members to fold lateral flaps of said wrapping sheets against end surfaces of said rolls; or (b) with second dynamic folding members, to insert lateral flaps of said wrapping sheets inside holes of respective winding cores of said rolls;

wherein said folding station comprises a first slide and a second slide arranged at the sides of said feed path and movable according to a direction of movement, transverse with respect to the feed path, and at least one actuator to move said first slide and said second slide along said direction of movement, wherein at least some of the first stationary folding members or of the second dynamic folding members are selectively constrainable to said first slide and said second slide; and wherein when said folding station is equipped with said second dynamic folding members, said second dynamic folding members comprise, on each side of the feed path, a plurality of mutually spaced apart punches, to insert the flaps of the wrapping sheet into the winding core of the rolls; wherein said second dynamic folding members comprise, on each side of the feed path, a disk-shaped member surrounding a riveting tip, to rivet and stabilize the flaps of the wrapping sheet inserted by said punches in the winding core of the rolls, each disk-shaped member being arranged downstream of the corresponding punches, with respect to a direction of feed of the rolls along said feed path; wherein the punches and the disk-shaped member on a first side of the feed path are carried by a first beam; wherein the punches and the disk-shaped member on a second side of the feed path are carried by a second beam; wherein the first beam and the second beam are supported respectively by said first slide and by said second slide.

25. A packaging machine for packing rolls of paper comprising:

an insertion station for inserting the rolls in wrapping sheets;

a feed path for the rolls;

a conveyor to feed the rolls along said feed path;

a folding station adapted to be equipped alternatively (a) with first stationary folding members to fold lateral flaps of said wrapping sheets against end surfaces of said rolls; or (b) with second dynamic folding members, to insert lateral flaps of said wrapping sheets inside holes of respective winding cores of said rolls;

wherein when said folding station is equipped with said second dynamic folding members said second dynamic folding members comprise, on each side of the feed path, at least a first stationary folding profile extending towards the insertion station; and wherein said second dynamic folding members comprise a second stationary folding profile positioned downstream of the first stationary folding profile, with respect to a direction of feed of the rolls along said feed path.

26. The machine according to claim 25 wherein said second stationary folding profile is positioned upstream of a respective disk-shaped member, relative to the direction of feed of the rolls along said feed path.

27. The machine according to claim 25 wherein said second stationary folding profile is aligned with a pair of punches which comprise a first punch and a second punch arranged coaxially to one another and on opposite sides of the path.

28. A packaging machine for packing rolls of paper comprising:

an insertion station for inserting the rolls in wrapping sheets;

a feed path for the rolls;

a conveyor to feed the rolls along said feed path;

a folding station adapted to be equipped alternatively (a) with first stationary folding members to fold lateral flaps of said wrapping sheets against end surfaces of said rolls; or (b) with second dynamic folding members, to insert lateral flaps of said wrapping sheets inside holes of respective winding cores of said rolls;

wherein when said folding station is equipped with said second dynamic folding members, said second dynamic folding members comprise, on each side of the feed path, a plurality of mutually spaced apart punches, to insert the flaps of the wrapping sheet into the winding core of the rolls; and wherein when said folding station is equipped with said second dynamic folding members, said second dynamic folding members comprise, on each side of the feed path, a moving folding profile, provided with a movement between an active position and a withdrawn position, synchronized with a forward movement of said conveyor.

29. The machine according to claim 28 wherein said moving folding profile comprises a shaped edge with a notch to cooperate with one of said punches.

* * * * *